United States Patent [19]

Brown

[11] Patent Number: 4,579,287

[45] Date of Patent: Apr. 1, 1986

[54] APPARATUS FOR DISPOSING OF FLUORESCENT LAMP TUBES

[76] Inventor: Wilson E. Brown, Rte. 2, Box 258, Moneta, Va. 24121

[21] Appl. No.: 632,008

[22] Filed: Jul. 18, 1984

[51] Int. Cl.[4] ..... B02C 19/14

[52] U.S. Cl. ..... 241/36; 241/37.5; 241/99; 241/101.7

[58] Field of Search ..... 241/99, 100, 101.7, 241/36, 37.5, 195, 189 R, 196

[56] References Cited

U.S. PATENT DOCUMENTS

| | | | |
|---|---|---|---|
| 2,558,255 | 6/1951 | Johnson et al. | 241/99 |
| 3,024,720 | 3/1962 | Welsh | 241/99 X |
| 3,623,672 | 11/1971 | DeFrank | 241/99 X |
| 3,779,157 | 12/1973 | Ross et al. | 241/99 X |
| 3,946,662 | 3/1976 | Ross, Jr. et al. | 241/99 X |
| 4,009,838 | 3/1977 | Tashman | 241/99 |

*Primary Examiner*—Mark Rosenbaum

*Attorney, Agent, or Firm*—Norman B. Rainer

[57] ABSTRACT

An apparatus is provided for safely disposing of fluorescent lamp tubes. The apparatus utilizes rapidly rotating chains to pulverize the tubes. The pulverizing mechanism is confined within an open-top container and suspended from a lid that covers the top of the container. The pulverized debris collects within the container. A plastic bag may line the interior of the container to facilitate disposal of the pulverized debris. A safety electrical switch is associated with the lid in a manner to prevent rotation of the chains if the lid is not properly seated upon the top of the container.

1 Claim, 3 Drawing Figures

APPARATUS FOR DISPOSING OF FLUORESCENT LAMP TUBES

BACKGROUND OF THE INVENTION

This invention relates to apparatus for breaking up and disposing of burned-out glass fluorescent lamp bulb tubes, and more particularly concerns apparatus which safely breaks fluorescent tubes to comminuted debris amenable to convenient accumulation and disposal.

Devices for breaking up fluorescent tubes are known. However, such devices are subject to various disadvantages which have thwarted their widespread utilization. Fluorescent tubes are commonly disposed of with the ordinary everyday trash of industrial buildings. Without a suitable device in a plant, factory or office building, etc., for breaking up and disposing of burned-out fluorescent tubes, much time is wasted in the excessive handling necessitated by collecting, transporting and storing the easily breakable and dangerous fluorescent tubes. In the course of such handling of the tubes for disposal purposes, accidents involving cuts and infections from broken phosphor-coated glass fluorescent tubes are of common occurrence.

It is accordingly an object of the present invention to provide apparatus for safely and conveniently disposing of glass fluorescent tubes.

It is another object of this invention to provide apparatus of the foregoing object which will break said glass tubes to a comminuted debris, and accumulate said debris for convenient disposal.

It is a further object of the present invention to provide apparatus of the aforesaid nature of high mobility and capable of thoroughly confining said debris.

It is still another object of this invention to provide an improved apparatus for disposal of glass tubes of simple and rugged construction which may be economically manufactured.

These objects and other objects and advantages of the invention will be apparent from the following description.

SUMMARY OF THE INVENTION

The above and other beneficial objects and advantages are accomplished in accordance with the present invention by an improved disposal apparatus for glass fluorescent tubes which comprises:

(a) a lid for covering a mating, open-top container, (b) at least one feed chute extending vertically through said lid and attached thereto, having an inlet opening disposed above the lid and an outlet opening disposed below the lid, and having an inside diameter adapted to closely accommodate said fluorescent tubes, (c) an electric motor mounted upon the upper surface of said lid, (d) means pendantly supported by said lid and driven by said motor for pulverizing a glass fluorescent tube as it emerges from said outlet opening of said feed chute, (e) on-off electrical switch means mounted upon the upper surface of said lid, (f) an electrical cutoff switch pendantly supported by said lid and adapted to inactivate said motor when said lid is raised from the underlying container, and (g) means disposed below said container to permit rolling movement thereof.

In a preferred embodiment of the invention, two feed chutes of different inside diameters are positioned in opposed relationship about said motor, and a lifting handle is mounted upon the upper surface of the lid. The pulverizing means is preferably comprised of two lengths of metal chain mounted in diametric opposition at the lower extremity of a shaft coupled to the motor and extending vertically downwardly into the container to a level below the outlet opening of the feed chute. The chains have a length adequate to reach across the outlet opening of the chute, and are of equal weight to provide centrifugal balance.

BRIEF DESCRIPTION OF THE DRAWING

For a fuller understanding of the nature and objects of the invention, reference should be had to the following detailed description taken in connection with the accompanying drawing forming a part of this specification and in which similar numerals of reference indicate corresponding parts in all the figures of the drawing.

DESCRIPTION OF THE PREFERRED EMBODIMENT

Figure 1:
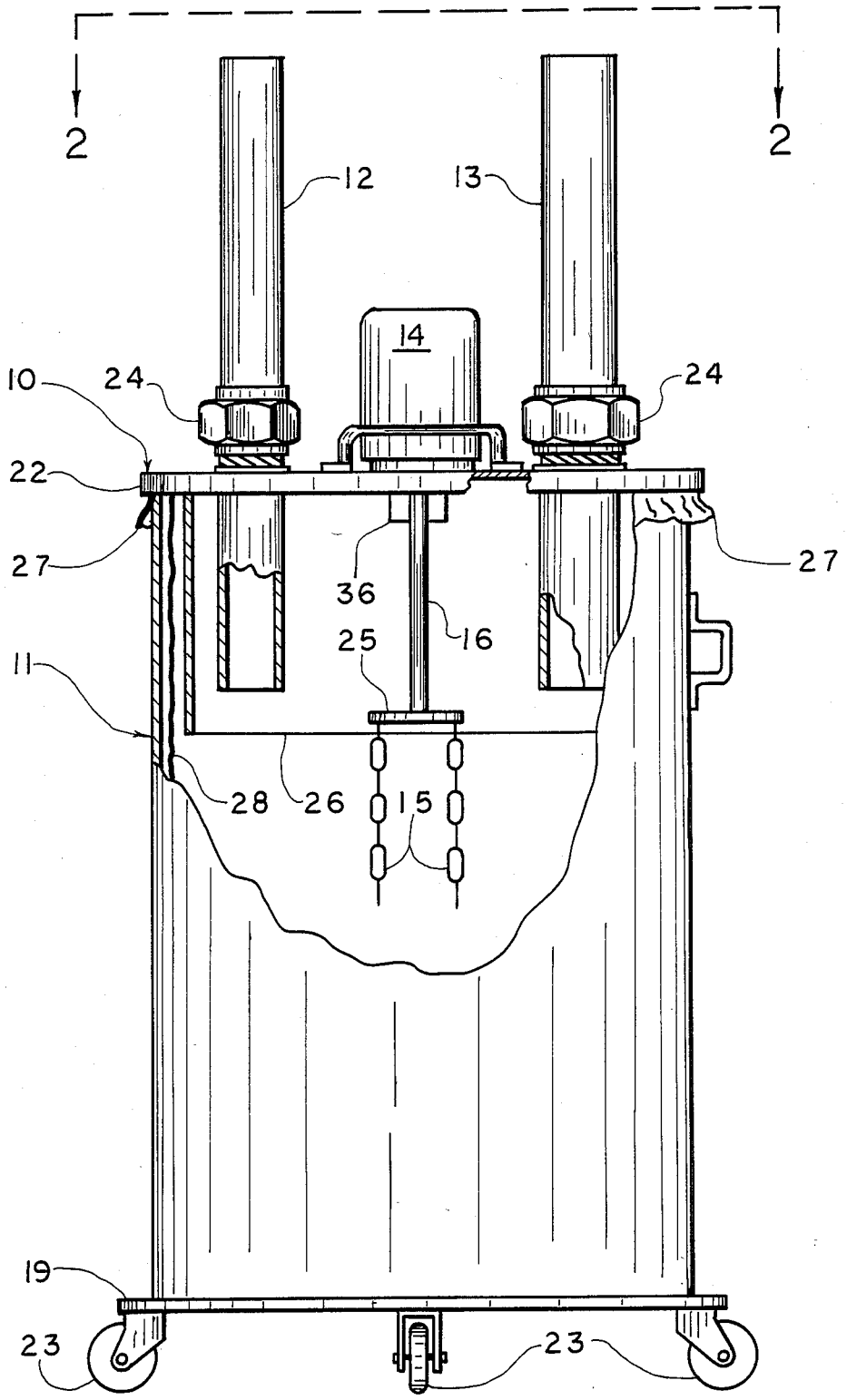
FIG. 1 is a side view of an embodiment of the disposal apparatus of the present invention, with parts broken away to reveal interior detail.
Figure 2:
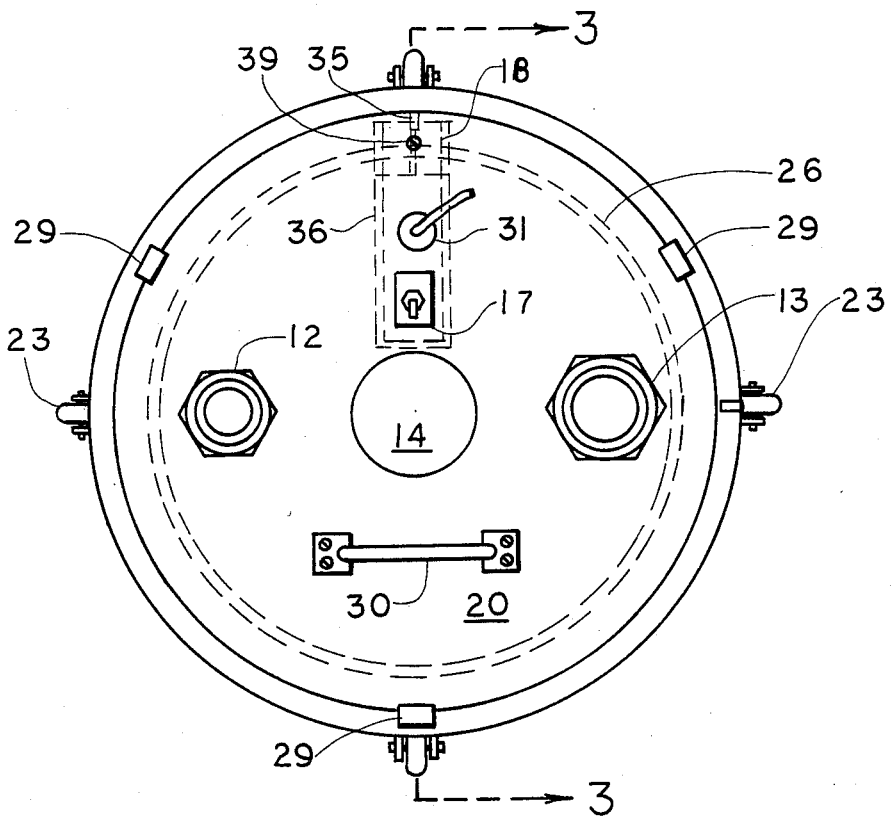
FIG. 2 is a top view of the apparatus of FIG. 1.
Figure 3:
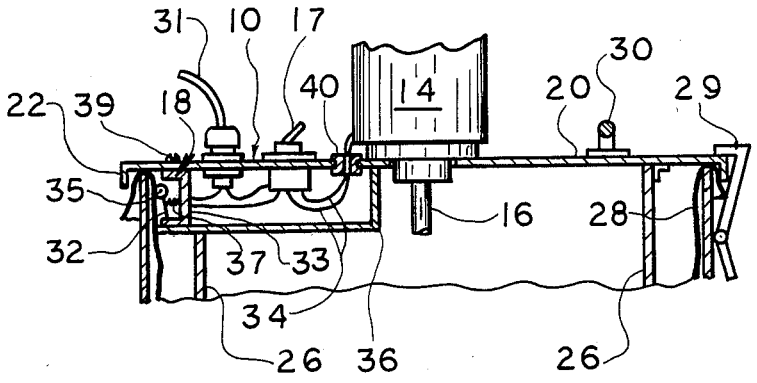
FIG. 3 is a fragmentary sectional view taken along the line 3—3 of FIG. 2.

Referring to FIGS. 1, 2 and 3, a disposal apparatus of the present invention is shown comprised of lid 10 adapted to cover open-top container 11 positioned upon rolling platform 19, feed chutes 12 and 13 extending vertically through said lid, electric motor 14 mounted upon the lid, pulverizing means comprised of paired chains 15 attached to the extremity of downwardly extending vertical shaft 16, and on-off electrical switch 17 and safety switch 18 adapted to control the motor.

Lid 10, having upper surface 20 and lower surface 21, is preferably fabricated of heavy gauge metal. The lid is of circular contour and provided with a downwardly turned lip 22 adapted to engage the underlying container. Appropriately sized and located apertures are contained in the lid to accommodate various components of the disposal apparatus, as will hereinafter be shown.

Container 11 is preferably a steel drum having a capacity in the range of 10 to 20 gallons. Rolling platform 19 may be of plastic, metal or wood construction. Caster wheels 23, of swivel design and numbering four or five, are positioned below the platform.

Chutes 12 and 13, having a circular cylindrical configuration, are of metal or plastic construction and have an inside diameter adapted to provide close-fitting sliding contact with fluorescent bulbs of standard diameters. The two chutes of the illustrated embodiment may, for example, accommodate fluorescent tubes of $1\frac{1}{2}''$ and $2\frac{1}{8}''$ diameters. In other embodiments one or more chutes of appropriate inside diameters may be utilized. The chutes perpendicularly penetrate lid 10, being held in place by collar sleeves 24. The lowermost extremity of each chute is positioned at an elevation about one inch above the site at which chains 15 contact fluorescent tubes dropped through the chute.

Motor 14 may, for example, be 1/20 horsepower, shaded pole, 115 volts, 60 Hz. The motor is preferably of totally enclosed construction and fan cooled. A suitable specific motor is a model 3M290 made by the Dayton Electric Company of Chicago, Ill. The motor is bolted to the upper face of the lid in a manner such that the spindle of the motor penetrates a close-fitting aperture in the lid. The spindle, or an extension thereof in the form of shaft 16, extends vertically downwardly into container 11. A yoke 25 is affixed to the lowermost extremity of shaft 16. A length of metal chain 15 is pendantly supported by each lateral extremity of yoke 25 in a manner such that the yoke and chain assembly is centrifugally balanced for rotative motion about the axis of shaft 16. The length of each chain is selected so that, when extended horizontally, the chains will cross the lowermost extremity of the chutes.

A shroud 26 of circular cylindrical configuration is pendantly supported by the lid. The diameter of the shroud is such as to encompass the chutes without permitting contact with the horizontally extended chains. The lowermost extremity of the shroud is located somewhat below yoke 25. The purpose of the shroud is to prevent glass fragments from being thrown at high velocity toward the wall of the container.

The mouth perimeter 27 of plastic liner bag 29 is draped about the upper extremity of the container and secured by lip 22 of lid 10. The liner bag is adapted to extend into the container, and is intended to collect the comminuted debris for easy disposal thereof. Were it not for the protective effect of shroud 26, liner bag 28 could not be employed.

The lid is secured to the upper extremity of the container by quick-release clamps 29 of conventional design. A handle 30 is affixed to the upper surface of the lid to facilitate manipulative handling thereof. An on-off electrical toggle switch 17 of conventional design controls the operation of the motor based upon electrical current supplied through service cord 31.

Safety electrical switch 18, housed within electrically insulative mounting frame 33, is attached by bolt 39 to the underside of the lid adjacent the container and exterior to shroud 26. Said switch, adapted to deactivate the motor if the lid is raised or improperly seated, utilizes arm 32 which is biased outwardly by spring 37 and adapted to abut against the inside wall of the container. The upper, abutting extremity of arm 32 is provided with roller 35.

When the container and lid are not in proper juxtaposition, arm 32 moves outwardly to its open position, thereby breaking the continuity of the electrical circuit needed to activate the motor. When forced to its closed position by the close proximity of the wall of the container, the electrical circuit is made continuous, thereby enabling the motor to be activated pursuant to control by on-off switch 17. A suitable safety switch for use in the present invention is 10 amp. microswitch #BZRW922-A2 distributed by the Microswitch Division of Honeywell Co., Freeport, Ill. Conductor wires 34, emerging from safety switch 18 and interactive in a series circuit with on-off switch 17, pass through rubber grommet 40 in the lid and connect with the motor.

A protective cowling 36 of box-like construction surrounds safety switch 18, on-off toggle switch 17, and conductive wires 34 interactive between said switches and motor. Said cowling prevents moving debris from abrasively interacting with said protected components.

While particular examples of the present invention have been shown and described, it is apparent that changes and modifications may be made therein without departing from the invention in its broadest aspects. The aim of the appended claims, therefore, is to cover all such changes and modifications as fall within the true spirit and scope of the invention.

Having thus described my invention, what is claimed is:

1. Apparatus for disposing of straight elongated fluorescent lamp tubes comprising:

(a) an open-topped container of circular cylindrical configuration, (b) a substantially flat lid adapted to removably mate with and cover the top of said container, said lid having an upper surface, and a lower surface adapted to be directed toward said container, (c) at least one feed chute of circular cylindrical configuration extending perpendicularly through said lid and attached thereto, having an inlet opening disposed above the upper surface of said lid and an outlet opening disposed below the lower surface of said lid, and having an inside diameter adapted to closely accommodate said fluorescent tubes, (d) an electric motor mounted upon the upper surface of said lid and having a downwardly extending rotatable shaft, (e) paired metal chains for pulverizing a fluorescent tube as it emerges from the outlet opening of said feed chute, said chains being mounted at diametrically opposed sites on said shaft and having lengths such as to extend across the outlet opening of said chute, (f) a downwardly opening shroud of circular configuration pendantly supported by said lid, the diameter of said shroud being such as to encompass said chute, and the lower extremity of said shroud being located below the sites at which said chains are mounted to said shaft, (g) a plastic liner bag, the open upper extremity of which drapes over the open top of said container and is held in such position by said lid, (h) on-off electrical switch means mounted upon the upper surface of said lid, (i) an electrical safety switch pendantly supported by the lower surface of said lid and adapted to inactivate said motor when said lid is raised from the underlying container, and (j) means disposed below said container to permit rolling movement thereof.

* * * * *